US009387352B2

(12) United States Patent
Habitzl

(10) Patent No.: US 9,387,352 B2
(45) Date of Patent: Jul. 12, 2016

(54) SYSTEM FOR EXTINGUISHING OR INERTING HAVING A SYNTHETIC LIQUID EXTINGUISHING AGENT

(71) Applicant: Minimax GmbH & Co. KG, Bad Oldesloe (DE)

(72) Inventor: Wolfgang Habitzl, Neumitterndorf (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 623 days.

(21) Appl. No.: 13/671,705

(22) Filed: Nov. 8, 2012

(65) Prior Publication Data

US 2013/0140045 A1 Jun. 6, 2013

(30) Foreign Application Priority Data

Nov. 18, 2011 (EP) ..... 11189697

(51) Int. Cl.
*A62C 3/00* (2006.01)
*A62C 35/02* (2006.01)
*A62C 37/16* (2006.01)

(52) U.S. Cl.
CPC . *A62C 3/00* (2013.01); *A62C 35/02* (2013.01); *A62C 37/16* (2013.01)

(58) Field of Classification Search
CPC ..... A62C 3/00; A62C 35/02; A62C 37/16
USPC ..... 169/7, 11, 13, 16, 3, 60, 5, 9
See application file for complete search history.

(56) References Cited

U.S. PATENT DOCUMENTS 2,132,132 A * 10/1938 Seat ..... A62C 35/605 137/112
3,339,638 A * 9/1967 Huthsing, Jr. ..... A62C 13/76 169/30
5,113,944 A * 5/1992 Nakagawa ..... A62C 35/68 169/13
5,125,458 A * 6/1992 Berman ..... 169/16
5,957,210 A * 9/1999 Cohrt ..... A62C 5/00 169/11
6,006,840 A * 12/1999 Sundholm ..... A62C 35/023 169/13
6,676,081 B2 * 1/2004 Grabow et al. ..... 244/129.2
8,813,858 B2 * 8/2014 Gatsonides et al. ..... 169/11
2002/0027143 A1 3/2002 Schoenrock et al.

(Continued)

FOREIGN PATENT DOCUMENTS

DE 4432346 C1 11/1995
DE 69601861 T2 8/1999

(Continued)

*Primary Examiner* — Len Tran
*Assistant Examiner* — Tuongminh Pham
(74) *Attorney, Agent, or Firm* — Harness, Dickey & Pierce, P.L.C.

(57) ABSTRACT

A system for extinguishing and/or inerting, including an extinguishing-agent tank, a conveyor device for an extinguishing agent, a pipeline, and nozzles. A synthetic liquid extinguishing agent (12) is stored at low pressure of up to 3 bar relative to 21° C. in the extinguishing-agent tank (1) and at least one incidence sensor detects fire signals and reports them to a fire detection panel and/or control panel (9) which activates the conveyor device (4) that conveys the synthetic liquid extinguishing agent by means of a pipeline (5) to nozzles (6), and the liquid extinguishing agents transitions into the gas phase after leaving the nozzles (6). The system represents a more cost-effective system that requires less technical efforts in comparison to previous systems having synthetic liquid extinguishing agents.

12 Claims, 1 Drawing Sheet

(56) References Cited

U.S. PATENT DOCUMENTS

2010/0263885 A1* 10/2010 Tuma ..... H05K 7/20781 169/46
2011/0253396 A1* 10/2011 Claessen ..... A62C 35/68 169/46

FOREIGN PATENT DOCUMENTS

DE 10051662 A1 5/2002
DE 102006048015 A1 4/2008
EP 0557275 B1 8/1996

* cited by examiner

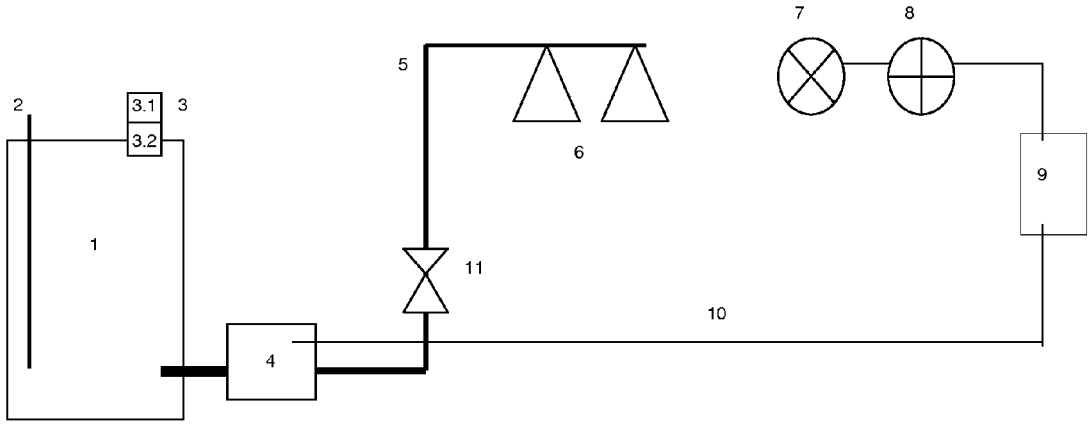
7
8
5
2
3.1
3
3.2
6
9
1
11
10
4

SYSTEM FOR EXTINGUISHING OR INERTING HAVING A SYNTHETIC LIQUID EXTINGUISHING AGENT

CROSS-REFERENCE TO RELATED APPLICATIONS

This application claims the benefit and priority of European Application No. 11189697.3, filed Nov. 18, 2011, the entire disclosure of which is incorporated herein by reference.

FIELD

The invention relates to a system for extinguishing and/or inerting using a synthetic liquid extinguishing agent.

BACKGROUND

The state of the art for liquid extinguishing agents such as water and aqueous solutions is represented by fire-extinguishing systems where this extinguishing liquid is stored in extinguishing-agent tanks and is conveyed, using a suitable conveyor device such as a pump, through pipes to the extinguishing nozzles and is discharged by means of these onto the source of the fire or a space to be inerted.

Synthetic extinguishing agents are stored in a liquid state in pressure vessels. Since in most cases the intrinsic vapor pressure of the extinguishing agent is not sufficient to convey the extinguishing agents in the prescribed time through a pipeline and to ensure the requisite minimum nozzle pressure, in most cases pressure is applied using a gas, for example nitrogen. At the nozzles, the extinguishing agent evaporates, creating a gaseous extinguishing-agent/air mixture that extinguishes efficiently. Synthetic liquid extinguishing or inerting agents are extinguishing agents such as halogenated carbohydrates, fluorocarbons, fluoro ketones or synthetic liquids having comparable properties. All components of the extinguishing system (pipes, valves, tanks, nozzles) must be designed for the appropriate pressure of at least 25 bar. This requires a corresponding technical and financial effort. Also the pressurization used requires additional storage volume in the pressure vessel or additional pressure vessels having the gas for pressurization.

The document US 2002/027143 A1 reveals an extinguishing system with liquefied gas in an extinguishing tank and special spray nozzles. Here, the extinguishing agent is stored in the extinguishing tank at a pressure of up to 100 psig, relative to a room temperature of 25° C. The extinguishing agent is forced under high pressure through the pipeline network, by a propellant under high pressure that is stored in a separate tank and is introduced into the extinguishing-agent tank. The discharge of the extinguishing-agent amount is not controlled by a fire detection panel and/or control panel or by concentration sensors.

EP 0557275 B1 describes a fire-extinguishing method where various synthetic extinguishing agents are used to prevent a fire from starting in a closed space.

Use of $N_2$ and $CO_2$ for inerting is described in DE 44 32 346 C1.

DE 100 51 662 A1 describes a method for extinguishing a fire that has started inside a closed space, using nitrogen, pressure cylinders serving to keep and store this gas.

DE 10 2006 048 015 A1 describes a fire-extinguishing system for a housing in which an extinguishing-agent tank having chemical liquids as extinguishing agents is arranged, NOVEC 1230, HFC 227a, HFC 125, Fett Ex, argon or $N_2$ being used as extinguishing agents, in the process a propellant discharging the extinguishing agent from a charging cartridge. In any case, the extinguishing-agent tank represents a pressure vessel.

DE 696 01 861 T2 describes a fire-extinguishing agent that comprises an at least partially fluorinated compound, and a method for extinguishing, fighting or preventing fires using such compositions, $C_4F_9OCH_3$ also being one of the means mentioned for fighting fires.

The vapor pressure of the synthetic liquid extinguishing agents mentioned can be between 50 and 0.1 bar at 21° C. To have a minimum pressure required for discharge, synthetic liquid extinguishing agents having a vapor pressure that is too low are superimposed with a gas, for example nitrogen, permanently or with pressure when triggering. During storage, transportation, conveying, and discharging by means of extinguishing nozzles in systems of this type it is therefore assumed that these extinguishing agents are gases for which pressure vessels, extinguishing nozzles, valves, pipeline networks, filling and monitoring devices, and special components are required that need certification and are expensive, which leads to the situation that erection and operation of fire-extinguishing systems using synthetic liquid extinguishing agents are really expensive. All components of the extinguishing system (pipes, valves, tanks, nozzles) must be designed for the corresponding pressure, at least for 25 bar. This requires a corresponding technical and financial effort. Also the pressurization used requires an additional storage volume in the pressure vessel and/or additional pressure vessels having the gas for pressurization.

SUMMARY

It is therefore the object of the disclosure to develop a system for extinguishing and/or inerting that is adapted to the properties of the extinguishing agent used.

The inventive solution envisages a system for extinguishing and inerting using a synthetic liquid, comprising an extinguishing-agent tank, a conveyor device for the extinguishing agent, a pipeline to the nozzles and fixtures, an incidence sensor being arranged that detects fire signals and reports them to a fire detection panel and/or control panel.

A synthetic liquid extinguishing agent is stored in a preferably closed extinguishing-agent tank at a low vapor pressure of <3 bar relative to 21° C. A conveyor device conveys the synthetic extinguishing agent by means of pipes to nozzles that evaporate it until a specific concentration is achieved in the space to be monitored. This concentration can be calculated in advance by means of corresponding calculations and dimensioning of the system or measured and controlled by a concentration sensor.

It is advantageous to use as a synthetic extinguishing agent a non-combustible, inflammable, electrically non-conducting liquid extinguishing agent having a vapor pressure of 25 to 28 kPa, preferably 26.8 kPa, at 25° C.

It is furthermore advantageous that the synthetic liquid extinguishing agent exhibits a density of 1,400 to 1,800 kg/$m^3$ at 25° C.

FK-5-1-12, or 1,1,1,2,2,4,5,5,5-NONAFLUORO-4-(TRIFLUOROMETHYL)-3-PENTANONE (C4F9OCH3) or other synthetic liquids such as fluoro ketones having comparable properties are suitable.

The extinguishing-agent tank represents a closed extinguishing-agent tank that may comprise plastic, metal or other suitable materials. The openings are arranged on it for receiving or for connecting filling-level monitoring systems, a drying cartridge having a valve, filling openings, withdrawal openings.

In a preferred embodiment, the extinguishing-agent tanks are designed for an operating pressure up to 3 bar. This makes cost-effective solutions possible and requires less effort for the technical certification processes.

A liquid-level monitoring system such as a mechanical float or an electrical liquid-level monitoring system such as on the basis of ultrasound can be arranged in the extinguishing-agent tank. The liquid-level monitoring system can emit a signal via electrical lines or also by means of radio to a fire detection panel and/or control panel.

A drying cartridge having a valve can be arranged in the extinguishing-agent tank. It can be a one-way or in multi-way dehumidifying cartridge for dehumidifying the air flowing in when extinguishing-agent is removed. If necessary, an integrated valve discharges the overpressure arising in the tank to the surroundings. This overpressure should amount to 2 bar. The threshold value depends on the extinguishing agent that is respectively used.

As an alternative a dehumidifier such as for example a drying cartridge, a pressure-protection mechanism for overpressures and negative pressures such as for example a valve or a combination of these instruments can be used.

The systems are preferably fitted at least with a pressure-protection mechanism against negative pressure, for example a valve, to equalize the reduction in volume arising when the extinguishing agent is discharged. As a rule, air is in this case drawn in from outside.

As a further alternative, equalization of the reduction in volume can take place by means of a gas, for example nitrogen, that is fed to the extinguishing tank from outside.

As a conveyor device it is advantageous to use a pump that is suited for conveying or only increasing the pressure of liquid media. The drive can be electric or pneumatic.

The pipelines used for conveying the synthetic liquid extinguishing agent can consist of metal, plastic or other suitable materials. The pipelines are preferably designed for the usual pressure level of 16 bar as is common for conventional water systems. In other advantageous embodiments, any other pressure levels are also possible.

The nozzles used for discharging the synthetic liquid extinguishing agent are nozzles such as they are used for finely atomizing water, for example full- or hollow-cone nozzles.

It is advantageous to arrange several conveyor devices between the extinguishing-agent tank and the nozzles. This enables the extinguishing agent to be discharged into different areas in which an extinguishing process is to be carried out.

It can also be advantageous to arrange several extinguishing-agent tanks instead of one extinguishing-agent tank.

In a preferred embodiment, there are arranged in the space to be monitored or to be extinguished and to be inerted, one or more concentration sensors that are designed as oxygen or extinguishing-agent sensors whose detected value enables a direct conclusion to be drawn as to the extinguishing-agent concentration in the space concerned. This value serves as a controlled variable for the amount of extinguishing agent to be discharged. For this purpose it is passed on to the fire detection panel and/or control panel that controls the discharge of the amount of extinguishing agent via the conveyor device according to a predetermined value or limit value.

To detect an alarm signal, incidence sensors are arranged. Advantageously they can be automatic incidence sensors. They detect deviations from the normal state of the surroundings such as fire variables or signals that point to a thermal decomposition and whose causes could be a fire or an incipient outbreak of fire or a smoldering fire or physical features of another disturbance case that can result in a fire. In the following text the signals that are detected by the incidence sensor are called fire signals.

Preferably these are smoke detectors, CO detectors, gas emission sensors, flame detectors, radiation detectors, aspirating smoke detection systems and manual trigger devices such as manual call points.

The fire detection panel and/or control panel carries out all of the procedures of monitoring, control, regulating, alarming, switching on and off, and reporting of operating states that are necessary for the function of the system. The fire detection panel and/or control panel can be connected both to the conveyor device and the liquid-level monitoring device. The fire detection panel and/or control panel furthermore detects and processes the signals of the incidence sensors.

Electrical control lines are provided to transmit control signals to sensors or actuators.

The inventive solution has the advantage that it is more cost-effective and requires less technical effort in comparison to previous systems having synthetic liquid extinguishing agents. By storing the extinguishing agent in the extinguishing-agent tank that is only designed up to 3 bar, and discharging using a conveyor device, no additional pressurization of the extinguishing agent is required, an additional storage volume in the pressure vessel of the extinguishing agent and/or additional pressure vessels with the gas for pressurization are dispensed with. Maintenance and service work is also made easier and simplified, since topping up the extinguishing agent does not take place in pressure vessels.

In the following text, the invention is explained in more detail using an exemplary embodiment and a FIGURE.

DRAWINGS

The FIGURE shows the schematic illustration of the inventive fire-extinguishing system, where an extinguishing-agent tank 1 contains the liquid synthetic extinguishing agent

DETAILED DESCRIPTION

The FIGURE provides a schematic illustration of a fire extinguishing system including an extinguishing agent tank 1 containing a liquid synthetic extinguishing agent FK-5-1-12, whereby only the inherent pressure from the extinguishing agent up to 3 bar at 21° C. prevails in the closed extinguishing-agent tank. In the extinguishing-agent tank a liquid-level monitoring system 2 is arranged that is designed as a mechanical float and is connected to the fire detection panel and/or control panel 9. As an option, there is located on the extinguishing-agent tank 1 a drying cartridge 3.1 having a valve 3.2 or separately a drying cartridge 3.1 and/or a valve 3.2 (not illustrated as separate). In this way an overpressure above 3 bar and a negative pressure in the extinguishing-agent tank 1 can be relieved. The drying cartridge 3.1 is thus an instrument which dehumidifies the air that is drawn in when the extinguishing agent is removed. From the extinguishing-agent tank 1, a pipeline 5 leads to the nozzles 6 by means of which the extinguishing agent is evaporated in the form of a gas in the space to be extinguished or inerted, a conveyor device 4 in the pipeline 5 conveys the synthetic liquid extinguishing agent to the nozzles 6.

Since the synthetic liquid extinguishing agent is discharged by the nozzles 6 in gas form, that is to say a defined pressure must prevail, the entire system functions without measuring the pressure. In systems where several extinguishing areas are supplied by one or more extinguishing-agent tanks, selector valves 11 are arranged in the pipelines 5. The selection valves 11 serve to selectively supply the areas with the extinguishing or inerting agents.

Between the conveyor device 4 and the fire detection panel and/or control panel 9, an electrical line 10 is arranged, preferably one that is monitored for wire breakage and/or a short-circuit, using which the conveyor device 4 can be turned on and then off. In a preferred embodiment, this switching-off takes place if a specific extinguishing-agent concentration in the space to be extinguished is achieved. To this end, as an option at least one concentration sensor 7 is arranged that measures the current oxygen or extinguishing-agent concentration and passes on a signal to the fire detection panel and/or control panel 9.

To detect a specific incidence in the protected area such as a fire, there is arranged in this area at least one incidence sensor 8 that in the case that it receives a signal that deviates from normal environmental conditions and receives a potential risk situation such as a fire, triggers a signal to the fire detection panel and/or control panel 9 and thus an alarm and activates the conveyor device 4.

LIST OF REFERENCE SYMBOLS USED

1 extinguishing-agent tank
2 liquid-level monitoring system
3 3.1 dehumidifier, e.g. drying cartridge having a valve
3.2 pressure-protection mechanism, e.g. valve
4 conveyor device
5 pipeline
6 nozzle
7 concentration sensor
8 incidence sensor
9 fire detection panel and/or control panel
10 electrical line
11 selector valve

The invention claimed is:

1. A system for extinguishing a fire and/or inerting a space to reduce a risk of a fire, comprising an extinguishing-agent tank (1), a pump (4) in communication with the extinguishing agent tank for conveying a synthetic extinguishing agent through a pipeline (5) and to a plurality of nozzles (6), a fire detection or control panel (9) is provided for selectively controlling the pump (4) in response to an incidence sensor (8), that detects fire signals and reports them to the fire detection panel or control panel (9), and at least one concentration sensor (7) in the space wherein the extinguishing-agent tank (1) contains the synthetic extinguishing agent Begin at a pressure which equals the vapor pressure of the synthetic extinguishing agent up to 3 bar and the pipeline (5) is designed for a pressure level of up to 16 bar, on the extinguishing-agent tank (1), a dehumidifier (3.1) and a pressure protection mechanism (3.2) are arranged, the pump (4) is arranged between the extinguishing-agent tank (1) and the nozzles (6) in the pipeline (5), and effective to convey the liquid synthetic extinguishing agent to the nozzles without pressure increase to the tank, an electrical line (10) is arranged between the pump (4) and the fire detection panel or control panel (9), the line being monitored for wire breakage and/or a short circuit, wherein the concentration sensor (7) measures one of a current oxygen or extinguishing agent concentration and reports a signal to the fire detection panel or control panel (9), and the fire detection panel or control panel (9) controls the discharge of the amount of extinguishing agent via the pump (4) according to a predetermined value or limit value of the measured one of a current oxygen or extinguishing agent concentration as a controlled variable for the amount of fire extinguishing agent to be discharged.

2. The system according to claim 1, wherein the extinguishing-agent supply via the pump (4) is turned on by the at least one incidence sensor (8).

3. The system according to claim 1, wherein the synthetic liquid extinguishing agent represents a non-combustible, inflammable, electrically non-conducting liquid having a vapor pressure of 0.1 to 3 bar at 21° C.

4. The system according to claim 3, wherein the liquid synthetic extinguishing agent exhibits a density of 1,400 $kg/m^3$ to 1,800 $kg/m^3$ at 21° C.

5. The system according to claim 1, wherein the liquid extinguishing agent is FK-5-1-12 ($C_4F_9OCH_3$) or a fluoro ketone.

6. The system according to claim 1, wherein the extinguishing-agent tank (1) represents a closed extinguishing-agent tank (1) that is made of plastic or metal.

7. The system according to claim 1, wherein a liquid-level monitoring system (2) is arranged in the extinguishing-agent tank (1).

8. The system according to claim 1, wherein an electrically or pneumatically operated pump is arranged as the pump (4).

9. The system according to claim 8, wherein several pumps (4) are arranged between the extinguishing-agent tank (1) and nozzles (6).

10. The system according to claim 1, wherein a selector valve (11) is arranged between the pump (4) and the nozzles (6).

11. The system according to claim 1, wherein the liquid-level monitoring system (2) is connected to the fire detection panel or control panel (9).

12. The system according to claim 1, wherein an automatic or a manual fire detector is arranged as the incidence sensor (8).

* * * * *